US006465952B1

(12) United States Patent
Itoh et al.

(10) Patent No.: US 6,465,952 B1
(45) Date of Patent: Oct. 15, 2002

(54) FED FLUSHED WITH HOT INERT GAS

(75) Inventors: Shigeo Itoh; Gentaro Tanaka; Mikio Yokoyama; Takeshi Tonegawa, all of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/265,696

(22) Filed: Mar. 10, 1999

(30) Foreign Application Priority Data

Mar. 27, 1998 (JP) ..... 10-081124

(51) Int. Cl.[7] ..... H01J 17/20

(52) U.S. Cl. ..... 313/549; 313/495; 313/496; 445/38; 445/25

(58) Field of Search ..... 313/495, 496, 313/497, 549; 315/167–169.3; 445/38, 42, 40, 41, 43, 25, 24

(56) References Cited

U.S. PATENT DOCUMENTS 5,688,708 A * 11/1997 Kato et al. ..... 437/51
5,788,551 A * 8/1998 Dynka et al. ..... 442/25
5,964,630 A * 10/1999 Slusarczuk et al. ..... 445/25
6,039,620 A * 3/2000 Itoh et al. ..... 445/25
6,077,141 A * 6/2000 Meyer et al. ..... 445/25

* cited by examiner

*Primary Examiner*—Vip Patel
(74) *Attorney, Agent, or Firm*—Oblon, Spivak, McClelland, Maier & Neustadt, P.C.

(57) ABSTRACT

A vacuum envelope that can improve the vacuum degree in a field emission device is provided. The vacuum envelope includes the cathode side substrate 2 on which field emission elements are formed and the anode substrate 1 spaced by a predetermined distance in the electron emission direction. At least two openings are formed before sealing the vacuum envelope. The remaining gas is ousted from the vacuum envelope by introducing a high temperature gas inside the vacuum envelope for a predetermined period of time. Thereafter, one of the openings is sealed while the envelope is being evacuated to a vacuum state through the remaining openings.

3 Claims, 7 Drawing Sheets

FED FLUSHED WITH HOT INERT GAS

BACKGROUND OF THE INVENTION

1. Field of the Invention

The present invention relates to a vacuum envelope that houses electron sources and electrodes each for gathering electrons emitted from an electron source. Particularly, the present invention relates to a flat vacuum envelope that houses field emission elements (field emission cathodes) each acting as an electron source and to a method for evacuating the same.

2. Description of the Related Art

Recently, the field emission electronic equipment, which includes a large number of micro field emission elements contained in a glass vacuum envelope and integrated in a vacuum micro-structure, is proceeding toward practical use as a vacuum microelectronic element.

As applications of the vacuum microelectronics technology, field emission devices including flat field emission display panels, pick-up tubes, electron beam lithography apparatuses, and the equivalents have been studied.

In a flat display panel embodying field emission elements, one pixel corresponds to a specific number of micro-cold cathodes (emitters).

Various types of cathodes including field emission elements, MIN-type electron emission elements, surface conduction-type emission elements, PN-junction-type electron emission elements, and others, each having a pointed end, have been proposed as the micro cold cathode.

As one most typical example, a field emission device (FED) is disclosed in "NIKKEI ELECTRONICS", No. 654, Jan. 29, 1996, pp. 89–98. In the FED device, the so-called Spindt type field emission element (FED) is well known.

In the Spindt field emission element, a large number of emitter electrodes E are formed on the cathode substrate K, as shown in FIG. 6. An insulating layer $SiO_2$ is laid over the cathode substrate K. A gate electrode GT is vapor-deposited over the insulating layer. Holes are formed in the gate electrode so as to expose the point of an emitter electrode E via each hole.

When a voltage Vgk is applied between the cathode electrode K and the gate electrode GT, the point of emitter electrode E emits electrons. An anode electrode A is placed so as to confront the cathode electrode K in the vacuum space. When an anode voltage Va is applied between the cathode electrode K and the anode electrode A, the anode electrode (A) gathers the emitted electrons. The field emission elements are arranged in group. When stripe gate electrodes are sequentially scanned while image signals are supplied to stripe cathode electrodes, the fluorescent materials coated on the cathode electrodes glow so that the display device operates as an indicator.

FIG. 7(*a*) is a perspective view illustrating the envelope of the above mentioned display panel. FIG. 7(*b*) is a side cross sectional view illustrating the envelope of the above mentioned display panel.

Referring to FIGS. 7(*a*) and 7(*b*), reference numeral 1 represents a glass substrate on the side of the anode (hereinafter referred to as an anode substrate) and 2 represents a glass substrate on the side of the cathode (hereinafter referred to as a cathode substrate). Micro-field emission elements are formed on the anode substrate so as to confront the cathode substrate. Anode electrodes are formed on the anode substrate so as to confront the cathode substrate.

The getter substrate 3 has the lower surface on which an exhaust hole 3*a* is formed to evacuate the inside of the envelope to a vacuum state. The getter 4 is for example, an evaporation-type getter. The getter is flashed at a high temperature after evacuating the envelope so that the inside of the envelope can be maintained to a high vacuum degree.

The juxtaposed structure of the cathode substrate 2 and the anode substrate 1 are sealed with a fritted glass 5 while the cathode substrate 2 is spaced from the anode substrate 1 by a small distance of 200 $\mu$m to 500 $\mu$m apart. The substrates 1 and 2 are generally arranged to be mutually shifted. Thus, the cathode electrode leads and gate electrode leads of the field emission elements can be placed to the portions where the substrates 1 and 2 do not confront from each other.

In the case of color displaying, anode electrode leads can be arranged on the cut portion (not shown) protruding toward the anode substrate.

As described above, the gap between the fringe of the cathode substrate 2 and the fringe of the anode substrate 1 are sealed with a fritted glass 5, except the getter substrate 3. An exhaust tube (not shown) is connected to the getter substrate 3 to evacuate the inside of the envelope by a vacuum pump.

In the vacuum envelope contains field emission elements, the cathode substrate 2 is separated from the anode substrate 1 by a small distance. In order to maintain the space of the envelope in a high vacuum degree, the evaporation-type getter 4 is generally disposed in the getter room. The getter 4 is vaporized by externally heating it at a high temperature. A getter mirror, which can adsorb the residual gas ousted from the electronic material or adsorbed after the evacuation step, is formed over the entire surface of the getter room.

In the flat display panel, since the very narrow space (t) of the vacuum envelope has a poor conductance to the gas flowing it, it is difficult that a vacuum pump draws the vacuum space to a high vacuum degree.

The ratio of the material for forming the existing field emission elements to the volume of the vacuum space is high. Hence, the evacuating process must be performed for a long time to bring the envelope to a predetermined vacuum degree by exhausting the remaining gas (particularly, moisture) adsorbed inside of the constituent materials.

In order to achieve a higher vacuum degree, the well-known getter flashing is performed after the evacuation process. Thereafter, the whole vacuum envelope is placed in an oven at about 200° C. for several hours to adsorb the remaining gas in the vacuum envelope. This makes the fabricating process more complex. The long evacuating step (e.g. 220 minutes) prolongs the product completion time.

SUMMARY OF THE INVENTION

The present invention is made to solve the above-mentioned problems.

Moreover, the objective of the invention is to provide a vacuum envelope that can improve the vacuum degree in a field emission device.

Another objective of the present invention is to provide a vacuum envelope evacuating method that can effectively evacuate gas remaining in the vacuum envelope.

The objective of the present invention is achieved by a vacuum envelope comprising a first substrate formed of a glass substrate; a second substrate arranged so as to confront the first substrate; and a side wall for separating the first substrate from the second substrate by a predetermined distance to form a space therebetween; wherein a first opening used to evacuate the inside of the envelope is formed in a part of a vacuum envelope assembled by the first substrate, the second substrate and the side wall; and wherein a second opening is formed in a part of the vacuum envelope, the second opening being sealed at a different position of the vacuum envelope, different from the position of the first opening. Thus, before sealing in a vacuum state, the envelope is backed while high temperature gas is being flowed using the first opening and the second opening.

According to the present invention, the vacuum envelope further comprises field emission elements formed on the first substrate and an anode electrode formed on the second substrate so as to confront the field emission elements.

According to the present invention, the vacuum envelope further comprises a getter room placed so as to cover the first opening.

Furthermore, a method for evacuating a vacuum envelope, comprises the steps of juxtaposing a first substrate and a second substrate so as to be spaced from each other a predetermined distance apart, the first substrate on which field emission elements are formed; temporarily framing the periphery of the first substrate and the periphery of the second substrate with fritted glass to form an envelope; introducing a gas at a high temperature for a predetermined period of time to flow through the envelope; sealing an outlet, except a main opening into which the gas is introduced; and evacuating the inside of the envelope to a vacuum state through the main opening, so that the envelope is maintained in a vacuum state.

According to the present invention, the method further comprises the step of previously forming at least two openings on a side portion of the envelope temporarily assembled.

In the method according to the present invention, the gas at a high temperature is selected from the group consisting of CO (carbon monoxide), $N_2$, $H_2$, and a mixed gas of an inert gas and CO, $N_2$, or $H_2$.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENTS

An embodiment of the present invention will be described below with reference to the attached drawings.

Figure 1:
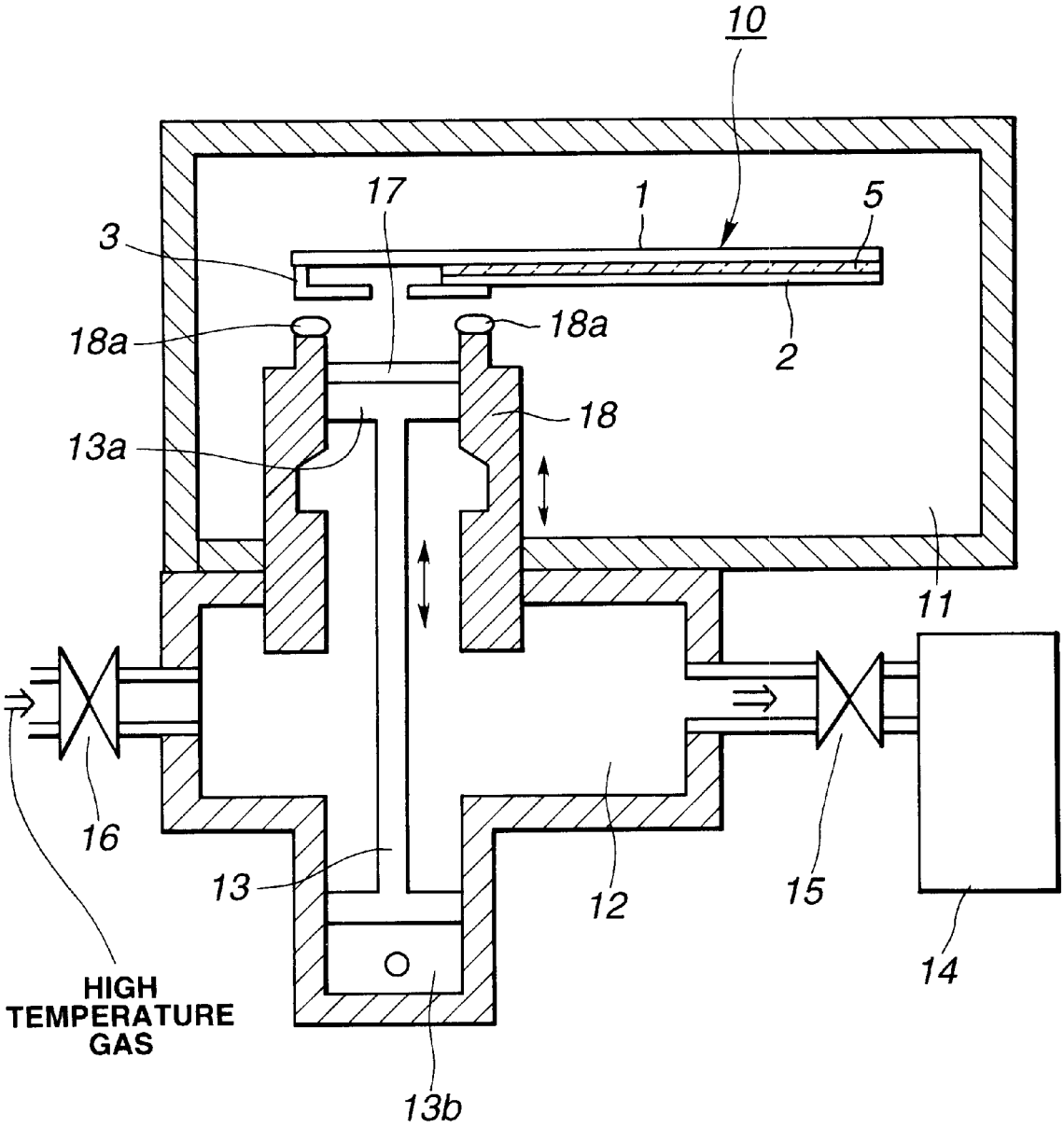
FIG. 1 is a schematic diagram illustrating an envelope evacuating method according to the present invention.

FIG. 1 shows a device embodying the envelope evacuating method according to the present invention.

Figure 7A:
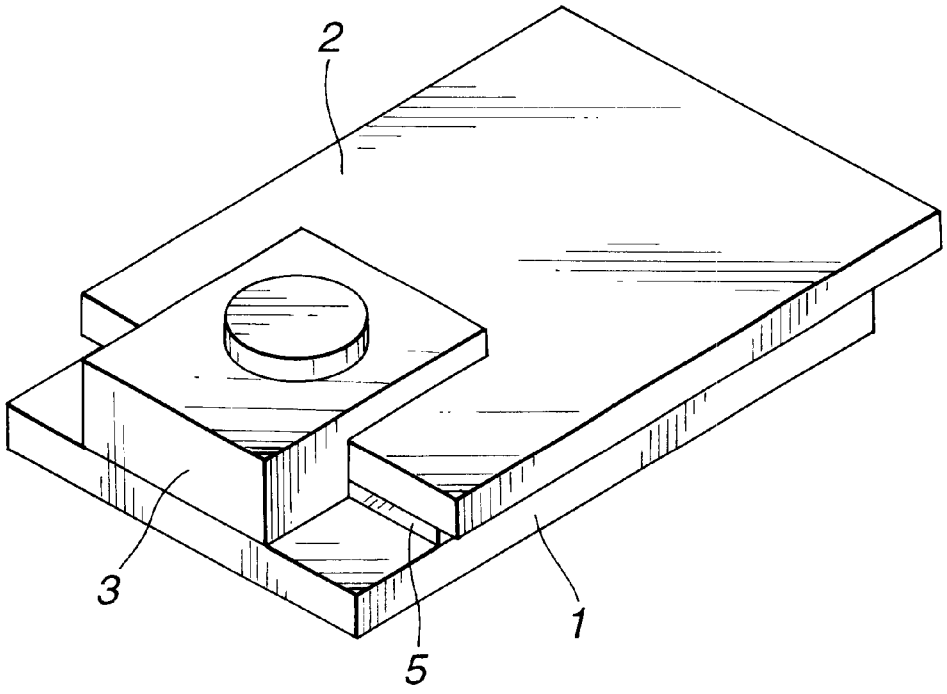
FIGS. 7(*a*) and 7(*b*) are diagrams explaining a field emission element.
Figure 7B:
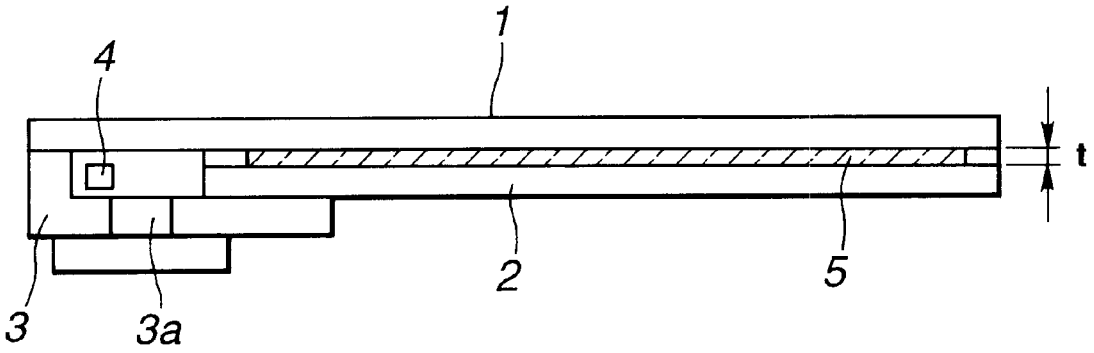

Referring to FIG. 1, reference numeral 10 represents a vacuum envelope of which the inside space is not in a sealed state, or in a pre-completion state. In FIG. 1, the same constituent elements as those of FIG. 7 are represented with like numerals.

In a sealing chamber 11, the vacuum envelope 10 is fixed with a supporting tool (not shown) and is heated by a heating apparatus. The sealing chamber 11 can be constructed of a furnace that can heat the sealing chamber 11 at temperatures at which the fritted glass 5 is melted.

An intake and exhaust chamber 12 is equipped under the sealing chamber to blow a high temperature gas into the vacuum envelope 10 or to evacuate the inside of the vacuum envelope 10 (as described later).

An elevating rod 13 ascends and descends when a pressure is applied to the cylinder room 13*b*. One end of the elevating rod 13 is formed of a head 13*a* on which a sealing body 17 for sealing the vacuum envelope 10 is placed.

A vacuum pump 14 is controlled to evacuate the inside of the intake and exhaust chamber 12 through the second valve 15.

A first valve 16 is opened to introduce a gas at a high temperature into the intake and exhaust chamber 12 (in the arrow direction).

The end of the elevating rod 13 is supported in the inner cylinder 18 and sidably driven by a drive mechanism (not shown). A flexible sealing body 18*a* is placed on the end of the cylinder 18 to hermetically seal with the getter room 3 when it is contacted against the getter room of the vacuum envelope 10. The cylinder chamber 13*b* vertically moves the elevating rod 13.

According to the present invention, when the vacuum envelope 10 is conveyed into the sealing chamber 11, the opening is left around the periphery of the fritted glass 5 laminated on the vacuum envelope 10. Hence, as described later with reference to FIG. 2, a high vacuum space can be obtained while the gas remaining inside the vacuum envelope 10 is being evacuated.

Figure 2A:
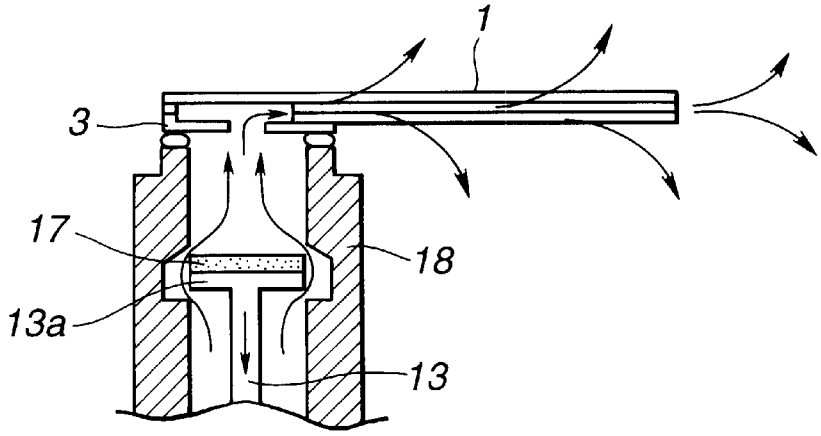
FIGS. 2(*a*), 2(*b*) and 2(*c*) are diagrams for explaining the process of evacuating a vacuum envelope.
Figure 2B:
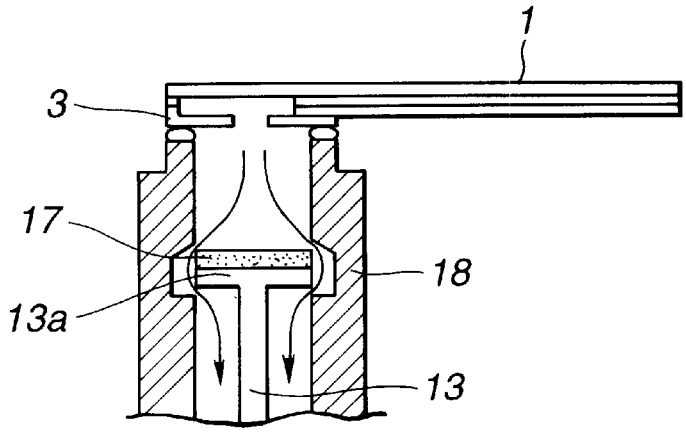
Figure 2C:
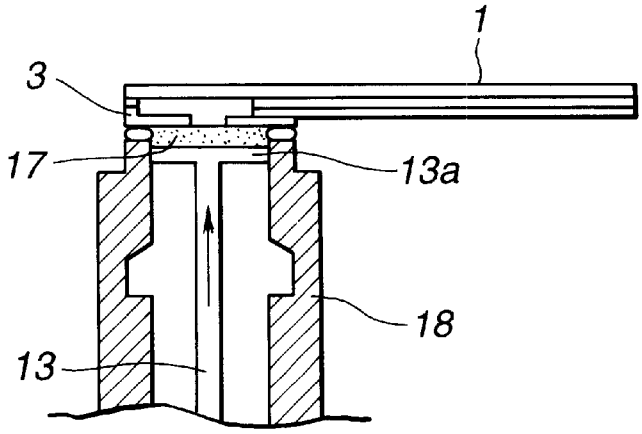

That is, as shown in FIG. 2(*a*), the inner cylinder 18 is first lifted to be in strong contact with the vacuum envelope 10 conveyed inside the sealing chamber 11. In such a state, the first valve 16 is opened to introduce gas at a high temperature into the vacuum envelope 10, as shown by the arrows.

Since the fritted glass 5 to be formed as the side wall of the vacuum envelope 10 is not completely sealed, the gas charged into the envelope 10 flows through the space between the first substrate 11 and the second substrate 12 in the arrow direction. The gas flows through the space in the vacuum envelope 10 and then is discharged out through the fritted glass portion 5 not sealed.

The flow of the high temperature gas allows the gas contents (mainly, moisture) remaining inside the envelope 10 to be exhausted sufficiently.

The gas temperature depends on the volume of the envelope 10 and is preferably 300° C. to 500° C. The gas flowing time depends on the temperature and is preferably several minutes to several hours.

After the high temperature gas is sufficiently flowing, the sealing chamber 11 is controlled to an elevated temperature. Thus, the fritted glass 5 applied to the peripheral portion of the envelope 10 is melted. Then the gas flowing through the envelope 10 is stopped.

At this time, it can be detected that the peripheral portion of the envelope 10 has been completely sealed with the fritted glass 5 by monitoring the pressure of the high temperature gas supplied.

After the complete sealing state is ascertained, the first valve 1 is closed to stop supplying the high temperature gas while the second valve 15 is opened.

The second valve 15 forms an exhaust passage to the vacuum pump 14. The vacuum pump 14 evacuates the gas remaining inside the envelope 10 in the arrow direction. The envelope 10 is evacuated, for example, to a vacuum degree of $10^{-3}$ to $10^{-5}$ Pa.

After the envelope 10 is evacuated to a sufficient vacuum state, the elevating loader 13 is lifted as shown in FIG. 2(*c*). Thus, the glass sealing body 17 placed on the head 13*a* is pushed against the exhaust inlet 3*a* of the getter room of the envelope 10. The heating device inside the sealing chamber 11 welds the portion around the exhaust inlet 3*a* with the sealing body 17.

In this welding step, the envelope 10 is maintained in a vacuum state. The envelope 10 is fed out by means of a conveying mechanism (not shown). Thereafter, the next envelope is conveyed into the evacuating chamber.

According to the same fabrication process, a flat envelope for a display panel can be fabricated. In that embodiment, since the exhaust inlet 3*a* of the vacuum envelope is formed with the getter room, the envelope can be increased to a higher vacuum degree by flashing the evaporation-type getter, in a similar manner to that to the common vacuum envelope. Thus, the envelope can be sustained to a higher vacuum state.

Figure 3:
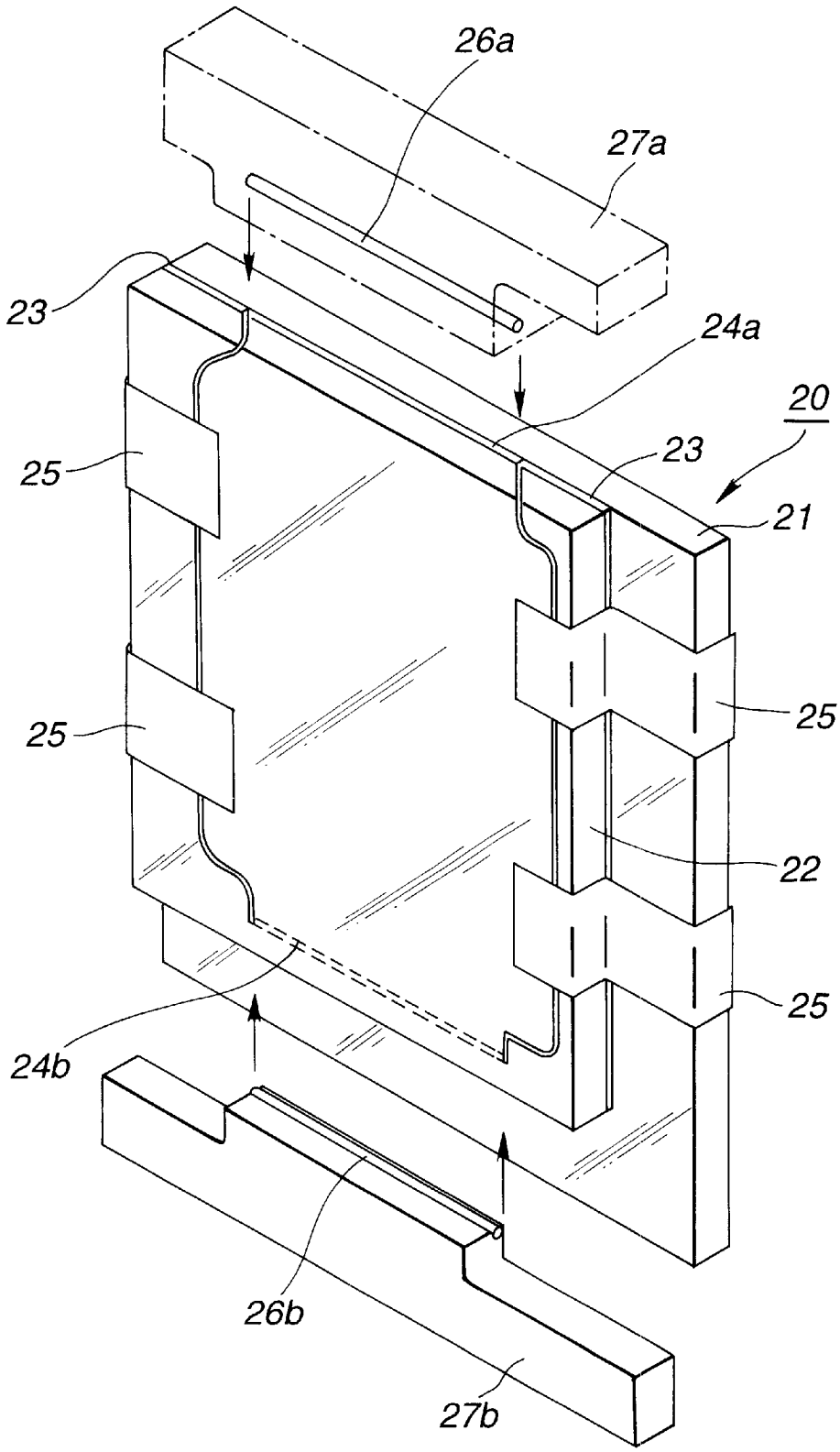
FIG. 3 is a perspective view illustrating a flat vacuum envelope.

FIG. 3 is a perspective view illustrating the envelope 20 according to another embodiment of the present invention.

In this embodiment, the envelope 20 is formed of a first substrate 21 having the inner surface on which field emission elements are formed, a second substrate 22 is arranged so as to confront the field emission elements and having anode electrodes for gathering electrons emitted from the field emission elements are formed, and a side wall 23 for hermetically sealing the space between the first substrate 21 and the second substrate 22.

As shown in FIG. 3, the envelope 20 has a first opening 24*a* and a second opening 24*b* opened vertically in the sidewall 23. Before the sealing step, the sucked gas flows from the first opening 24*a* to the second opening 24*b*.

Clips (or tapes) 25, 25, . . . temporarily fix the first glass substrate 21 and the second glass substrate 22. Glass sealing body 26*a* is a member used for sealing the first opening while the glass sealing body 26*b* is a member used sealing the second opening.

The glass sealing members (26*a*, 26*b* ) are respectively supported by the welding heating members (27*a*, 27*b* ) and are welded to hermetically seal the inside of the envelope after the evacuating step (as described later).

In the embodiment, a vacuum envelope 20 is completed by flowing a gas, e.g. CO, $N_2$, $H_2$, or a mixture of one of them and an inert gas, at a high temperature, into the inside of the envelope and then evacuating the envelope to a high vacuum state.

Figure 4A:
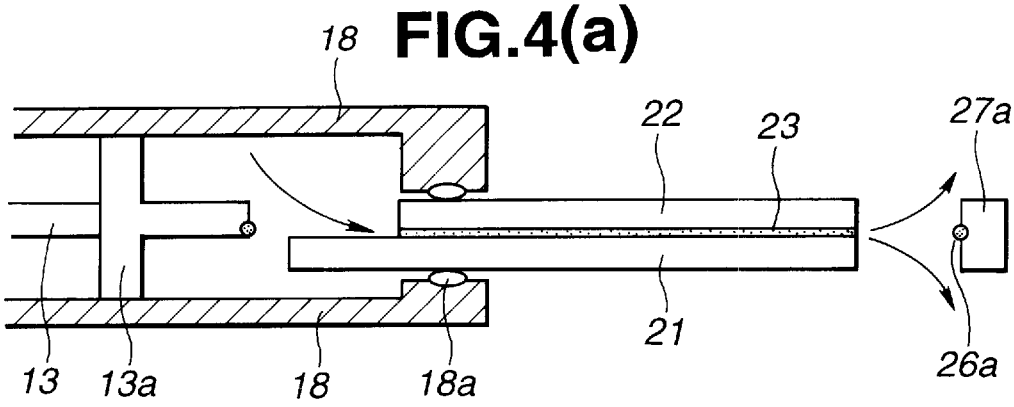
FIGS. 4(*a*), 4(*b*) and 4(*c*) are diagrams for explaining the process of evacuating a flat envelope.
Figure 4B:
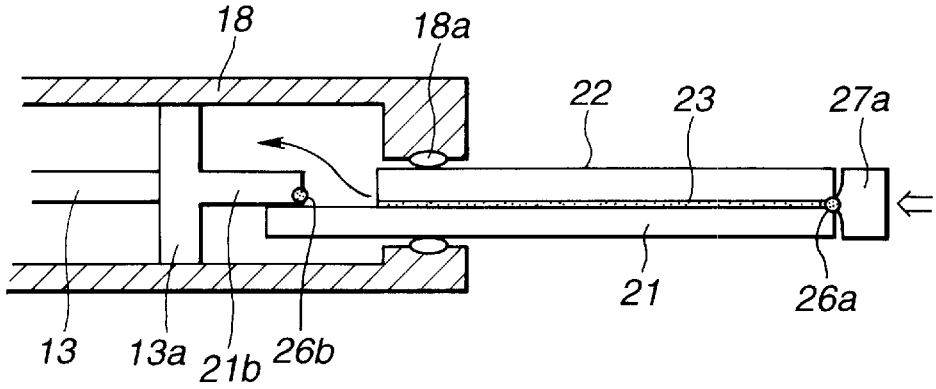
Figure 4C:
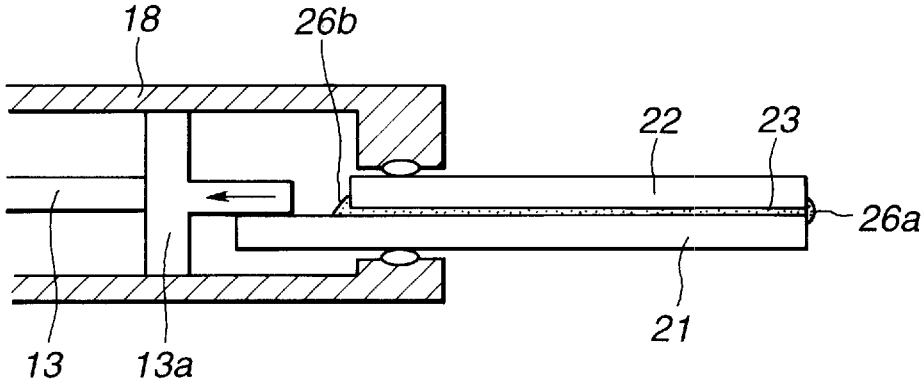

That is, as shown in FIG. 4(*a*), first, the heating members 27*a* and 27*b* are separately disposed at both the ends of the envelope 20. A high temperature gas is charged into the envelope 20 via the inner cylinder 20, in the arrow direction. The gas passing through the envelope 20 is discharged from the opening 24*a*.

By flowing the high temperature gas, the degassing and evacuating preliminary step is performed which blows out gas contents adhered on and left inside the envelope and sweeps out moisture adhered on various devices or material contained in the envelope.

Next, as shown in FIG. 4(*b*), the heating member 27*a* on the side of the second opening 24*a* butts against the sealing member 26*a*. The second opening 24*a* is welded and sealed with the sealing member 26*a* through the heating operation.

After the completion of the welding step, the vacuum pump is driven to evacuate the inside of the envelope 20 from the first opening 24*b*. When the inside of the envelope is evacuated to a sufficient vacuum state, the first opening 24*b* is sealed with the sealing member 26*b*. Thereafter, the vacuum envelope is detached from the inner cylinder 18 and then is taken out of the sealing chamber.

That embodiment evacuates the getter room 3 but requires the flat inner cylinder 18 which directly blows and exhausts a gas at a high temperature from the opening formed in the side wall of the envelope. However, a very flat, slim vacuum envelope can be fabricated.

After the evacuation step, tape-like non-evaporation-type getters or flat, wire evaporation getters may be previously incorporated at the four corners of the envelope. Thus, the unwanted residual gases can be adsorbed by activating the getter after formation of the envelope.

As described above, the present invention is characterized in that high temperature gases are flown through the inside of the envelope in the previous evacuating step. In the envelope, at least two openings must be previously formed to improve the residual gas sweeping effect due to the high temperature gas flowing operation.

In order to flow gas smoothly in the flat space, it is required to effectively match the gas pressure, the opening area, and the viscosity resistance of the flowing path.

As well known in the vacuum technology, the flow of gas becomes turbulent at a high gas pressure, becomes a viscosity flow at a low gas pressure, and becomes a molecular flow at a lower gas pressure.

Figure 5A:
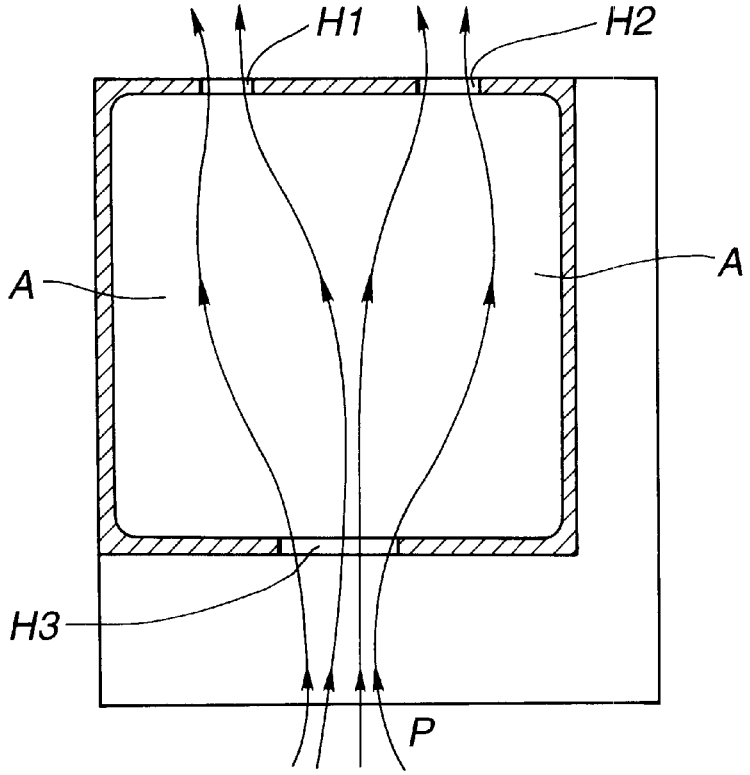
FIGS. 5(*a*) and 5(*b*) are diagrams explaining high temperature gas flowing inside an envelope.
Figure 5B:
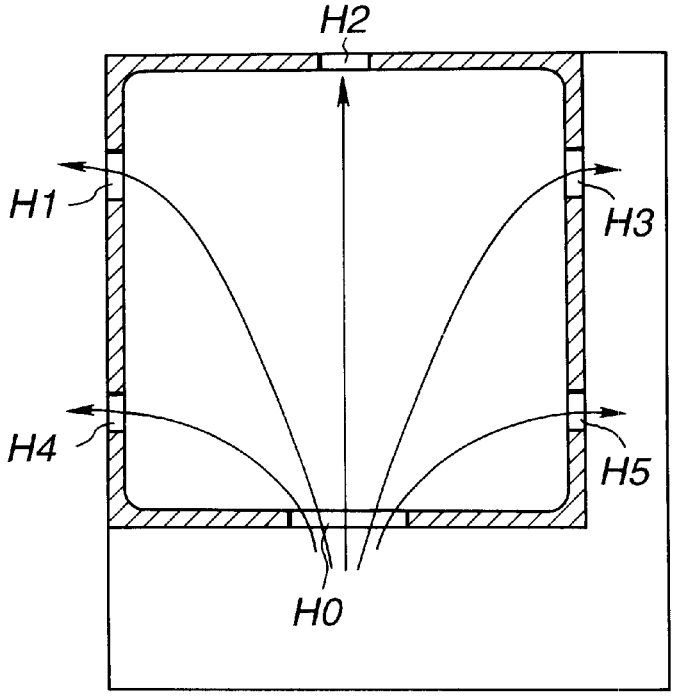
Figure 6:
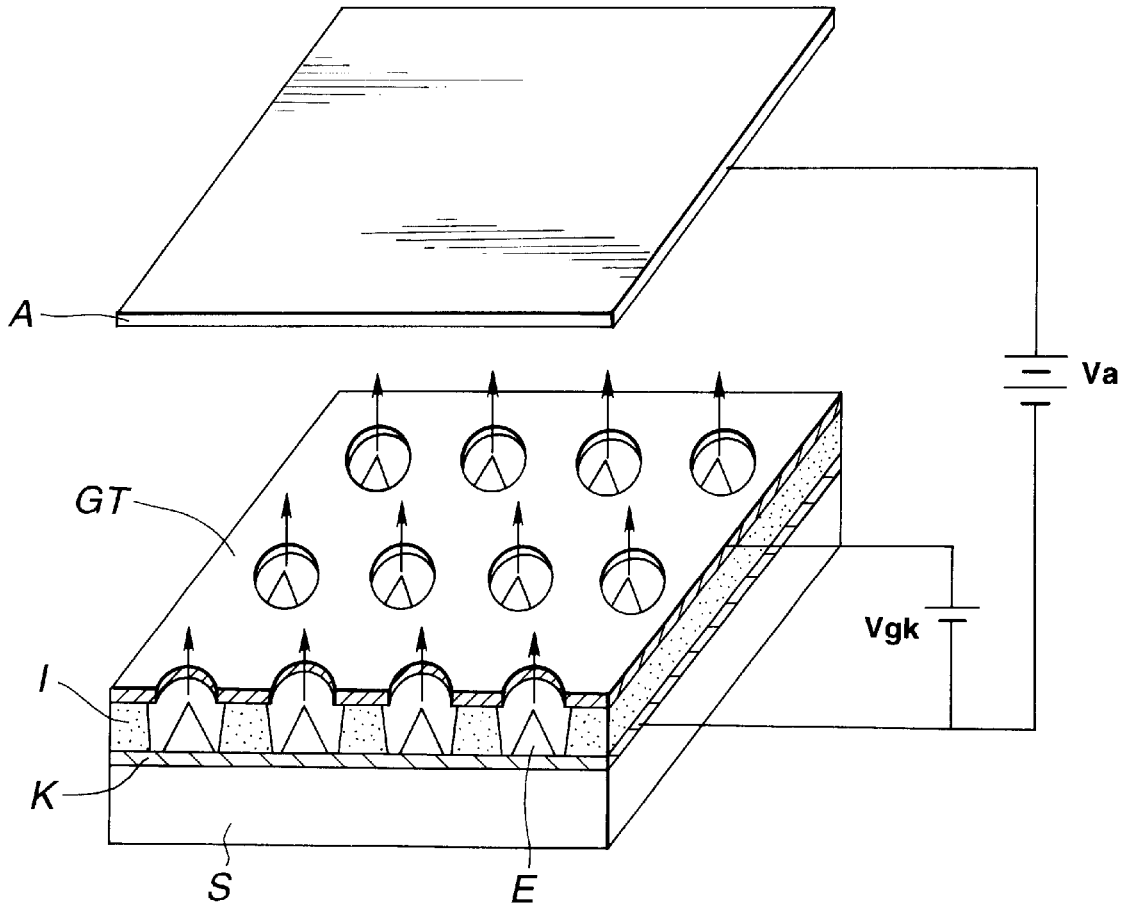
FIG. 6 is a schematic perspective view partially illustrating a vacuum envelope.

According to the present invention, it is preferable to increase the residual gas exhausting effect by decreasing the conductance to gas flowing in the envelope, as shown in FIGS. 5(*a*) and 5(*b*) and by setting the gas pressure, the positions of openings H1, H2, H3, H4, and H5, and the number of openings to obtain a viscosity region with good efficiency, under the above-mentioned flow conditions.

As described above, in the vacuum envelope and the vacuum envelope evacuating method according to the present invention, an opening, which allows gas at high temperature to flow through the envelope, is previously formed and the inside of the envelope is effectively baked before evacuation to oust the residual gas. Hence, the remaining gas is effectively exhausted in the post evacuation steps so that the narrow space can be brought to a high vacuum state in a relatively short time.

Moreover, the vacuum envelope can be more small-sized by sealing the evacuation chamber with a chipless cover or by omitting the getter room.

In the flat display panel employing field emission elements, the amount of gas remaining in the vacuum envelope largely depends on the product serviceable life and the quality. However, in spite of such a problem, the second embodiment of the present invention, a small, slim vacuum envelope can be fabricated by omitting the getter room.

What is claimed is:

1. A method for evacuating a vacuum envelope, comprising the steps of:

juxtaposing a first substrate and a second substrate so as to be spaced from each other a predetermined distance apart, said first substrate having field emission elements formed thereon;

temporarily framing the periphery of said first substrate and the periphery of said second substrate with fritted glass to form an envelope;

introducing a gas at a predetermined temperature of from 300° C. to 500° C. for a predetermined period of time to flow through said envelope;

sealing an outlet, except a main opening into which said gas is introduced; and evacuating the inside of said envelope to a vacuum state through said main opening so as to remove the gas together with moisture and contaminants within the envelope, so that said envelope is maintained in a vacuum state.

2. A method as defined in claim 1, further comprising the step of:

previously forming at least two openings on a side portion of said envelope temporarily assembled.

3. A method as defined in claims 1 or 2, wherein said gas at said predetermined temperature is selected from the group consisting of CO (carbon monoxide), $N_2$, $H_2$, and a mixed gas of an inert gas and CO, $N_2$, or $H_2$.

* * * * *